United States Patent [19]

McMullen

[11] 4,071,647

[45] Jan. 31, 1978

[54] RUBBER GOODS

[75] Inventor: Philip B. McMullen, Ardmore, Northern Ireland

[73] Assignee: The Goodyear Tire & Rubber Company, Akron, Ohio

[21] Appl. No.: 808,508

[22] Filed: June 21, 1977

Related U.S. Application Data

[63] Continuation of Ser. No. 465,018, April 27, 1974, abandoned.

[30] Foreign Application Priority Data

May 8, 1973 United Kingdom ..... 21968/73

[51] Int. Cl.[2] ..... B32B 3/06

[52] U.S. Cl. ..... 428/102; 428/105; 428/107; 428/108; 428/121; 428/192; 428/224

[58] Field of Search ..... 428/102, 105, 107, 108, 428/113, 192, 225, 121, 224

[56] References Cited

U.S. PATENT DOCUMENTS

| | | | |
|---|---|---|---|
| 3,515,621 | 6/1970 | Watson | 428/109 |
| 3,642,561 | 2/1972 | Grobner | 428/102 |
| 3,769,142 | 9/1973 | Holmes et al. | 428/225 |
| 3,895,151 | 7/1975 | Mattheus | 428/102 |
| 3,900,062 | 8/1975 | Neville et al. | 428/107 |
| 3,998,986 | 12/1976 | Williams | 428/102 |

*Primary Examiner*—James J. Bell

*Attorney, Agent, or Firm*—F. W. Brunner; L. A. Germain

[57] ABSTRACT

This invention relates to a textile reinforcement for use in the manufacture of rubber or polymer products in which the textile elements running in both lengthwise and generally crosswise directions are not interwoven but held together by a stitching of lightweight construction and bonded by rubber or polymer material. In addition, preferably the principal textile members are ones which include only the normal "producer's" twist rather than the usual twisted cord construction.

3 Claims, 1 Drawing Figure

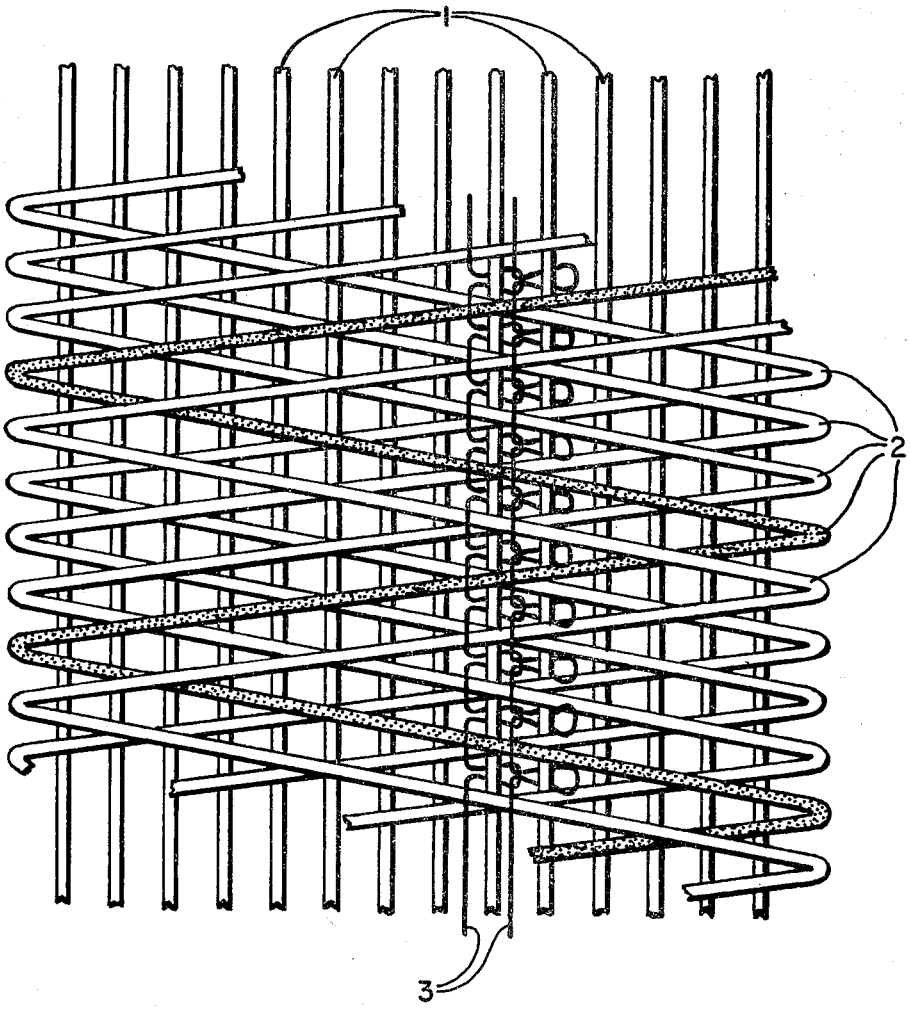
1
2
3

RUBBER GOODS

This is a continuation of application Ser. No. 465,018 filed Apr. 27, 1974 now abandoned.

This invention relates to articles possessing an internally reinforced sheet-like portion, and more especially to conveyor belts in which a matrix of elastomeric material in more or less sheet form has embedded therein a reinforcing yarn fabric serving to impart an improvement in tensile strength and in tear resistance to the base elastomer. For convenience, this specification refers to rubber goods, but the invention also extends to articles of synthetic thermoplastic or like polymers.

A woven fabric must be made of a suitable twisted yarn. If the yarn is made of threads of discontinuous fibres, e.g. staple fibre, and not adequately twisted to bond it together, the fibers will tend to come apart during the mechanical handling of the warp and weft during weaving. Even if the yarn is made of a plurality of continuous filaments, an untwised yarn is difficult to weave and handle, because the filaments can separate.

Moreover, a woven fabric consists essentially of a number of yarns each of which is undulatory in nature. This gives every woven fabric a 'braided' texture.

Both of the above factors (the high degree of twist and the undulatory shape) give the fabric a high degree of stretch. This renders it unsuitable as reinforcement, since the elastomer rubber article is easily pulled out of its desired shape.

There has been a prior proposal to overcome this problem by using a "non-braided" fabric. This consists of a fabric wherein the warp threads are not interwoven with the weft threads, but where instead both sides of the plane of warp threads are united with a plurality of overlaid weft threads by stitching with a low-denier stitching thread.

In this prior proposal the difficulty is recognized that a warp which resists extension and possesses good mechanical qualities may not be suitably adhesive to the rubber of the rubber article. To overcome this adhesion problem it was therefore proposed to make the weft threads of a different and more adhesive material; to maximize the coverage of the warp from the rubber, even up to the extent of completely masking the warp on both sides by a plurality of contiguous parallel weft threads; and to minimize the denier of the bonding thread, so as to expose the maximum proportion of the weft threads to the rubber.

The present invention utilizes a specific form of "non-braided" fabric as reinforcement, and has among is objectives to provide a cheaper form of stitch-bonded fabric as a reinforcement, which alleviates or overcomes the extensibility and adhesion problems by an expedient not hitherto envisaged.

The present invention consists in a polymer article possessing an extended sheet-like portion internally reinforced with a stitch-bonded fabric possessing a plurality of parallel warp threads and a plurality of parallel weft threads united by an adhesive or a plurality of parallel stitching threads; wherein the warp and the weft threads are formed in a yarn comprising a plurality of continuous filaments and possessing only producers twist or minor modifications thereof, to minimize their extensibility and improve bonding to the fabric.

The yarns used can be "singles" yarns (e.g. 840/1 or 1260/1) but can also be plied or multiple yarns e.g. 840/8.

The term "producers twist or minor modifications thereof" may be explained as follows. It is customary when producing a yarn, and especially a yarn of continuous filaments, (e.g. by extrusion or more recently by controlled fibrillation) to provide it with only that amount of twist which enables it to be wound up for sale. The eventual user, when producing woven fabrics gives the yarn the desired degree of twist for his purposes. Usually, the producers twist is so small by comparison with the eventual twist that it can be ignored; thus, producers twist can be as low as one twist per three inches (7.5 cms) whereas the twist impart prior to weaving can be 36 twist per inch (2.5 cm).

However, it is possible to give a yarn with say 0.5 turns an inch up to 1 or 1.5 or even 2 or more twists per inch without expensive twist equipment, and the present invention includes such possibilities.

By making up a fabric using only yarn with "producers twist or minor modifications thereof" there is a better conversion ratio of yarn to fabric since twisting a yarn shortens it. Moreover, a twisted yarn is more extensible since the extensibility due to stretching apart of the turns must be added to the inherent extensibility of the synthetic polymer filament. Moreover again, the twisting process is expensive.

In addition to the above advantages, there is however an unexpected improvement in adhesion between the fabric and the matrix of the conveyor belt (for instance) being reinforced, and thus an increase in working life. While the applicant does not intend to be restricted in the scope of his claims by any theory about the reason for this improvement, it appears possible that one or more of the following reasons may play some part:

1. As compared to a "braided" or woven structure the threads are not undulatory. Thus there are no kinks or waves in the threads which (on the microscopic level) try to straighten out when the article is stretched so as to give the risk of local internal relative tensions tending to disunite the thread from the adjacent matrix.

2. As compared to a twisted yarn, whether in a woven or a non-braided fabric as in the prior art, the threads are substantially untwisted. Thus there are no rotational stresses as between the thread and the adjacent matrix when the article is stretched, which could again give rise to local internal relative tensions disuniting the thread from its matrix.

3. As compared to a twisted yarn, the threads are rather more open in texture, thus allowing a good matrix-to-polymer contact area, (i.e. good fibre surface area) and thereby improving adhesion.

In addition to the above basic feature, certain subsidiary features become possible in the invention as compared to the prior art. Thus, since it is no longer necessary to "shield" the warp threads from the matrix, the weft threads may be located on the side only of the warp threads with the stitching threads extending longitudinally (e.g. one per warp end) to unite the warp and weft. The efficacy of mechanical fastening of the finished conveyor belt is a direct function of the denier of the stitch thread.

Such a reinforcement is lighter and cheaper than those in use in the prior art.

The weft threads can be angled e.g. up to 15° in relation to the 90° transverse direction. Indeed, two superposed sets of parallel weft threads each angled at the same angle but in opposite directions so as to form an overlapping system of weft threads is preferred so that any bias is compensated. Of course, the so-called "sets"

of weft threads need not be discontinuous lengths, and each set may extend to the edge of the fabric and return at the same angle but in the opposite direction — i.e., the "reflected" angle — to constitute another so-called "set" of threads.

To further improve adhesion, and insulating properties, as well as making the fabric easier to handle during manufacture, the stitch-bonded fabric may further be associated with a layer of synthetic polymeric thermoplastic material (or of a natural or synthetic elastomer) located on one side or between the warp and weft threads.

While the present invention has a primary object the provision of a conveyor belt, it can be used to make up a strip-shaped or other shaped polymer article in a form which itself can be used e.g. as a helical reinforcement in hole piping, or molded into shape, or incorporated into other bodies to be molded, e.g. tire carcasses. The polymer, as referred to herein, may be a natural or synthetic rubber or a synthetic thermoplastic material.

The invention will be further described with reference to the accompanying single FIGURE of drawing, which is a diagram showing a stitch-bonded fabric in plan view.

In the FIGURE, a set of spaced parallel warp threads 1, only possessing producers twist forms the base layer of a stitch-bonded fabric. Over these a band of weft threads 2, typically from 100 to 150 mm. wide, and containing 150 to 200 spaced apart threads is angled, so that the whole area is covered with a double layer of threads in two compensating and overlapping configurations. Thus if the fabric is of 60 inches (150 cm) loomstate width the angle of the bias would be from 7° to 10°.

The whole is stitched together by 420 denier nylon stitcing thread 3, one thread per warp end with the loops interlocking as shown. Alternatively the layers can be bonded together adhesively.

The above dimensions and numerical values are only given by way of example, and can be varied. For instance other deniers and materials can be used to make the stitches 3.

Also, the gauge of the needle bed and the courses per inch of the stitch construction which is mentioned above are not limiting factors in the practice of this invention.

While certain representative embodiments and details have been shown for the purpose of illustrating the invention, it will be apparent to those skilled in this art that various changes and modifications may be made therein without departing from the spirit or scope of the invention.

What is claimed is:

1. A fabric structure for use in reinforcing material in polymeric structures comprising a plurality of parallel warp threads and at least one layer of a plurality of parallel weft threads extending transversely at an angle of 75° to 90° to said warp threads and positioned on one side thereof and means stitch-bonding said warp and weft threads into a unitary construction, each of said warp threads being formed of a plurality of continuous filaments and having no more than two twists per inch of length whereby the extensibility of said warp threads is reduced to a minimum, said unitary construction providing increased penetration of the polymetric material into the fabric structure.

2. A fabric structure as claimed in claim 1 in which the weft threads extend from one edge of said warp threads to the other with the angle of the threads extending in one direction being the same angle but opposite to the angle of the thread as it extends in the opposite direction.

3. A fabric structure as claimed in claim 1 in which there are two layers of weft threads with the second layer being formed in a manner similar to the first layer.

* * * * *

UNITED STATES PATENT AND TRADEMARK OFFICE

CERTIFICATE OF CORRECTION

PATENT NO. : 4,071,647

DATED : January 31, 1978

INVENTOR(S) : Philip B McMullen

It is certified that error appears in the above-identified patent and that said Letters Patent are hereby corrected as shown below:

Column 2, line 55, "the" first occurrence should be -- one --.

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*